United States Patent [19]

Buchanan

[11] 4,146,056

[45] Mar. 27, 1979

[54] STEAM AND FUEL OIL CONTROL AND PURGE VALVE

[76] Inventor: Bascom F. Buchanan, Cox Rd., Portland, Conn. 06480

[21] Appl. No.: 848,137

[22] Filed: Nov. 3, 1977

Related U.S. Application Data

[63] Continuation-in-part of Ser. No. 741,054, Nov. 11, 1976, abandoned.

[51] Int. Cl.[2] ..... F16K 11/16

[52] U.S. Cl. ..... 137/630.22; 137/597; 431/121

[58] Field of Search ..... 137/597, 630.16, 630.17, 137/630.22; 431/29, 121

[56] References Cited

U.S. PATENT DOCUMENTS

| | | | |
|---|---|---|---|
| 1,120,474 | 12/1914 | Grimes | 137/630.22 |
| 2,520,069 | 8/1950 | Simpson | 137/630.16 |
| 2,652,071 | 9/1953 | Morrison | 137/630.22 |
| 3,065,783 | 11/1962 | Hindenlang | 431/29 |

*Primary Examiner*—Robert G. Nilson

*Attorney, Agent, or Firm*—McCormick, Paulding & Huber

[57] ABSTRACT

A steam and fuel oil control and purge valve has a body which defines generally radial steam and oil inlet and discharge ports, in top-to-bottom order coaxial generally cylindrical steam discharge and inlet chambers and oil discharge and inlet chambers, and three coaxial smaller cylindrical openings in top-to-bottom order respectively between the steam discharge and inlet chamber, the steam inlet and oil discharge chamber, and the oil discharge and inlet chambers. A cylindrical steam valve and actuator is slidable in the opening between the steam inlet and oil discharge chambers and has axially spaced upper and lower radial openings and an internal interconnecting axial passageway. In its closed position, a seating surface at an upper end of the valve and actuator closes the upper cylindrical opening between the steam discharge and inlet chambers and the lower radial opening in the valve and actuator is closed by the wall of the intermediate cylindrical opening in the valve body. In a partially open purge position, the upper and lower valve and actuator openings communicate respectively with the steam inlet and oil discharge chambers to steam purge the fuel oil line. In a fully open position, the steam inlet and discharge chambers communicate through the upper cylindrical opening, the upper radial valve opening is closed by the wall of the intermediate cylindrical opening in the valve body to terminate communication between the steam inlet and oil discharge chambers, and an axially projecting actuating pin on the valve and actuator opens a coaxial poppet-type oil valve to connect the oil inlet and discharge chambers.

24 Claims, 8 Drawing Figures

STEAM AND FUEL OIL CONTROL AND PURGE VALVE

RELATED APPLICATIONS

This application is a continuation-in-part of U.S. application Ser. No. 741,054, filed on Nov. 11, 1976, in the name of Bascom Frank Buchanan on STEAM AND FUEL OIL CONTROL AND PURGE VALVE, now abandoned.

BACKGROUND OF THE INVENTION

In the firing of industrial oil burners and auxiliary or igniter burners associated with large utility burners, it has been a conventional practice to employ steam as an atomizing agent for the fuel oil. Further, the same source of steam is conventionally employed in the purging of fuel oil lines for safety and other considerations. Three (3) valves are ordinarily employed in order to accommodate the various valving functions, e.g. closing both steam and fuel oil lines, introducing steam to the fuel oil line in the purge operation, and passing steam and fuel oil respectively through the steam and fuel oil lines for a running operation.

SUMMARY OF THE INVENTION

It is the general object of the present invention to provide a single valve capable of fulfilling each of the foregoing functions and which is yet of desirably simple construction, highly efficient in operation, and dependable over a long service life.

DESCRIPTION OF THE PREFERRED EMBODIMENTS

Figure 1:
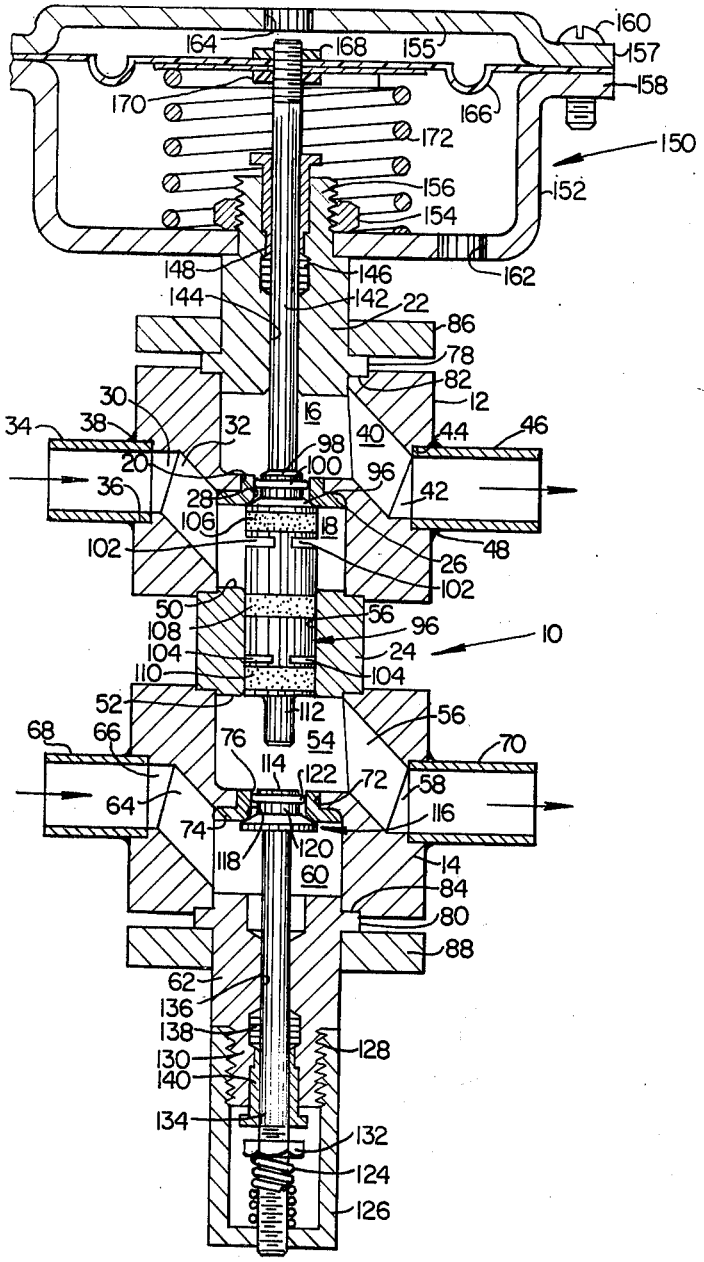
FIG. 1 of the drawings is a vertical sectional view through the valve of the present invention and an illustrative actuator associated therewith, the valve elements being illustrated in a closed position.

Referring particularly to FIG. 1, it will be observed that the valve of the present invention has a body, indicated generally at 10, which comprises several discrete parts. Similar upper and lower body parts 12, 14 take the form of blocks bored axially and in other geometrical directions to provide various chambers and ports. In this regard, it should be noted that directional and geometric terminology such as "axial," "upper," "lower," "top-to-botton," etc. is used herein for convenience of description only and is not to be taken as limiting the scope of the invention in the specification or the claims which follow.

The upper body part or block 12 is provided with upper and lower axial bores 16, 18 and a coaxial reduced diameter cylindrical opening 20 therebetween. A top cap or plug 22 serves as a closure member for the bore 16 to define a cylindrical chamber above but in communication with the reduced diameter cylindrical opening 20. The bore or chamber 16 may hereafter be referred to as a steam discharge chamber. The lower axial bore 18 is closed by a smaller intermediate body part or block 24 to define a second cylindrical chamber beneath the reduced diameter opening 20. The bore or chamber 18 may hereafter be referred to as a steam inlet chamber.

As will be apparent, fluid flow communication between the chambers 16 and 18 can be selectively established and controlled through the cylindrical opening 20. Preferably, a valve seat is provided at the opening 20 and may comprise a Stainless Steel L-shaped annular member 26 as illustrated. The seat 26, secured in the opening 20, is provided with a central cylindrical through opening 28 for the axial passage of fluid therethrough from the steam inlet chamber 18 to the steam discharge chamber 16.

For a supply of steam to the inlet chamber 18, a steam inlet port comprises a radial bore 30 and a communicating bore 32 inclined between radial and axial planes and extending to the inlet chamber. Optionally, a tubular steam inlet fitting 34 is provided with an inner end portion entered in an enlarged radial bore 36. The fitting may be welded in position as indicated at 38 and provides for the remote connection of a steam supply line or conduit not shown. Welding of the supply line or conduit to the fitting may thus be accomplished in spaced relationship with the upper valve body block 12.

The steam discharge chamber 16 has an associated discharge port partially formed by an inclined bore 40 which communicates with the chamber at its inner end. At its outer end, the bore 40 communicates with a radial bore 42 and an enlarged radial bore 44 receives an inner end portion of an optional tubular fitting 46. The tubular fitting 46 may be welded in position as indicated at 48.

The intermediate body block 24 has a short cylindrical projection 50 which extends axially at an upper end portion and which enters and closes the bore 18. Similarly, a short cylindrical and axially extending projection 52 at the lower end of the block 24 extends into and closes an upper axial bore 54 at an upper portion of the lower body block 14. A centrally located cylindrical through opening 56 in the intermediate body block 24 provides for selective communication between the steam inlet chamber 18 and the bore 54 in the block 14.

The upper bore 54 in the body block 14 forms an oil discharge chamber having an outlet port comprising inclined and radial portions 56, 58 as described above for the ports in the block 12. At a lower end portion of the block 14 an axial bore 60 is closed by a bottom cap or plug member 62 to form a chamber which may hereinafter be referred to as an oil inlet chamber. The oil inlet chamber 60 has an inlet port comprising inclined portion 64 and radial portion 66. Tubular fittings 68 and 70 may be provided welded in place respectively at the oil inlet and discharge ports.

As in the block 12, a reduced diameter coaxial opening 72 is provided between the oil inlet and discharge chamber 60, 54 and has an associated annular valve seat 74. The valve seat 74 preferably takes the form of a Stainless Steel L-shaped member identical with the seat 26 and having a similar central through opening 76. As will be apparent, communication between the oil inlet and discharge chambers 64 can be selectively established and controlled at the opening 76.

Figure 2:
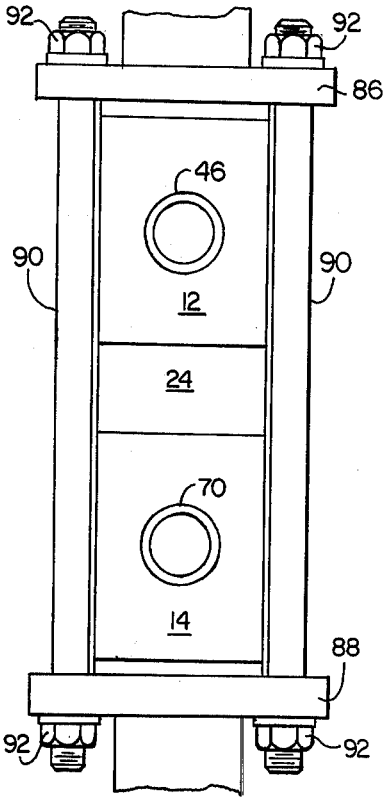
FIG. 2 is a front elevation of the valve.

The top and bottom caps or plugs 22, 62 serve as closure means as indicated and also serve an important assembly function. That is, the caps or plugs are provided with similar radially projecting annular flanges 78, 80 which are received respectively in shallow annular grooves 82, 84 in the blocks 12, 14. The flange 78 is engaged by a top plate 86 and the flange 80 has an associated bottom plate 88. As best illustrated in FIG. 2, the top and bottom plates 86, 88 serve a clamping and assembly function together with vertically extending tie rods 90, 90. Two (2) tie rods 90, 90 are shown, but it will be apparent that four (4) such rods may be provided respectively at corners of the plates 86, 88. The tie rods have threaded end portions and nuts 92, 92 engaged therewith serve to secure the plates 86, 88 in clamping engagement respectively with the flanges 78 and 80. Thus, it will be apparent that the various body parts comprising plugs 22, 62, blocks 12, 14 and intermediate block 24 can be securely clamped in vertically aligned and assembled position as illustrated. When it is desired to disassemble the valve body for cleaning or other maintenance functions, it is necessary merely to remove the nuts 92, 92 and to vertically disassemble the valve parts, the end caps or plugs and the end plates.

In accordance with the present invention, a steam valve and actuator member is operatively associated with the valve body and is movable therein between first, second and third positions respectively for a closing operation, a purge operation, and a running operation. The valve and actuator member, indicated generally by the reference numeral 94, may vary widely in form but preferably takes the form of a cylindrical slide valve disposed within and guided by the wall of the cylindrical opening 56 in the intermediate body block 24. In FIG. 1, the valve and actuator member 94 is illustrated in its first or closed position and it will be observed that a seating surface 96 at an upper portion thereof is disposed in sealing engagement with the aforementioned annular seat 26. The seating surface 96 takes a frusto-conical form and a short diametrically reduced axial projection 98 extends upwardly therefrom and within the central opening 28 of the annular seat 26. A soft annular sealing member 100 is mounted in an appropriate groove in the projection 98 and engages the wall of the opening 28 in the seat. Thus, both hard and soft seats are provided, metal-to-metal contact occurring between the frusto-conical surface 96 and the annular seat 26, and metal-to-soft seal contact between the sealing member 98 and the wall of the opening 28.

A diametrically enlarged intermediate or body portion of the valve and actuator member 94 is provided with first and second radial openings 102 and 104. The openings 102, 104 shown are spaced apart axially and, viewed axially, may take a somewhat half-moon shape. Preferably, two (2) oppositely disposed openings 102, 102 are provided and two (2) oppositely disposed openings 104, 104. The openings 102, 104 communicate internally of the valve and actuator member and it will be apparent that an axial bore may be conveniently provided to interconnect the same. Further, the axial spacing of the openings 102, 104 is judiciously determined in relation to the amount or degree of valve movement and the axial dimension of the cylindrical opening 56 in the intermediate body block 24. Further explanation is given below in this regard.

First, second and third annular sealing means are also preferably provided and are arranged in axially spaced relationship along the valve and actuator member 94. The sealing means may take the form of similar annular soft seals 106, 108 and 110 in top-to-bottom order. The first and third seals 106 and 110 are disposed axially outwardly respectively of the openings 102, 104 and the second seal 108 is disposed therebetween. The seals 106, 108 and 110 are each adapted to engage the wall of the cylindrical opening 56 in the body block 24 and to prevent steam and/or oil leakage along and between the valve and actuator member and the wall.

At its lower end portion, the valve and actuator member 94 has an axially projecting actuating pin 112 which cooperates with a flat surface 114 at an upper end portion of an oil valve member indicated generally at 116. The oil valve 116 is preferably of the poppet type and has a frusto-conical seating surface 118 engageable in sealing contact with the aforementioned annular valve seat 74. A diametrically reduced axial projection 120 extends upwardly from the frusto-conical surface 118 and carries an annular soft seal 122. The soft seal 122 engages the surface of the through opening 76 to provide a second seat. Thus, as above, both hard and soft seats are provided, the former between the frusto-conical surface 118 and the annular seat 74 and the latter between the soft seal 122 and the wall of the opening 76 in the seat.

The oil valve member 116 is urged toward the closed position of FIG. 1 by a biasing means which may vary in form within the scope of the invention. As shown, the biasing means comprises a coil spring 124 disposed within and seated at its lower end on a lower end wall of a cup-shaped member 126. The member 126 is threadably engaged at 128 with a depending reduced diameter axial projection 130 on the lower cap or plug 62. At its upper end, the coil spring 124 is seated on an adjustment nut 132 threadably engaged with a lower end portion of a valve stem 134. The valve stem 134 projects axially downwardly from the oil valve member 116 and is slidably received in a suitable opening 136 in the end cap or plug 62. A packing 138 is preferably provided about the stem 134 and secured in position by a retainer 140.

From the foregoing, it will be apparent that the oil valve member 116 can be engaged by the actuating pin 112 to urge the same downwardly from its first or closed position illustrated to a second or open position. In the open position of the valve member, communication is established between the inlet and discharge chambers 60, 54 for flow of fuel oil through the opening 76 in the valve seat 74.

Reverting to the steam valve and actuating member 94, it will be observed that an axially projecting stem is also provided therefor at 142. The valve stem 142 is slidably received within a suitable through opening 144 in the top cap or plug 22 and extends upwardly therebeyond. A packing for the valve stem is preferably provided at 146 and secured in position by a retainer 148. As will be apparent, the position of the valve and actuator member 94 can be readily controlled from a remote location above the cap or plug member 22.

Actuating means for the steam valve and actuator member may vary widely within the scope of the invention. An illustrative actuating means is indicated generally at 150 and is of the pneumatic type. A two-part housing for the actuator 150 comprises a lower cup-shaped member 152 secured in upright position by a nut 154 threadably engaged with a stud 156 projecting axially upwardly from the cap or plug 122. An upper housing member 155 takes an inverted cup-shape and may be secured to the lower member 152 as by means of suitable annular flanges 157, 158 disposed respectively on said upper and lower members and secured together by appropriate screws or bolts and nuts 160, 160. An atmospheric port or vent 162 is provided in the lower housing member 152 and a port 164 in the upper member 155 may be connected with a controlled source of air under pressure. Disposed within the housing of the actuator 150 is a diaphram 166 peripherally clamped between the flanges 157 and 158 and secured to an upper end portion of the stem 142 by means of suitable nuts 168 and 170. A return spring 172 may be of the coil type with an upper end portion seated beneath the diaphram 166 and a lower end portion thereof seated on the bottom wall of the cup-shaped housing member 152.

Figure 3:
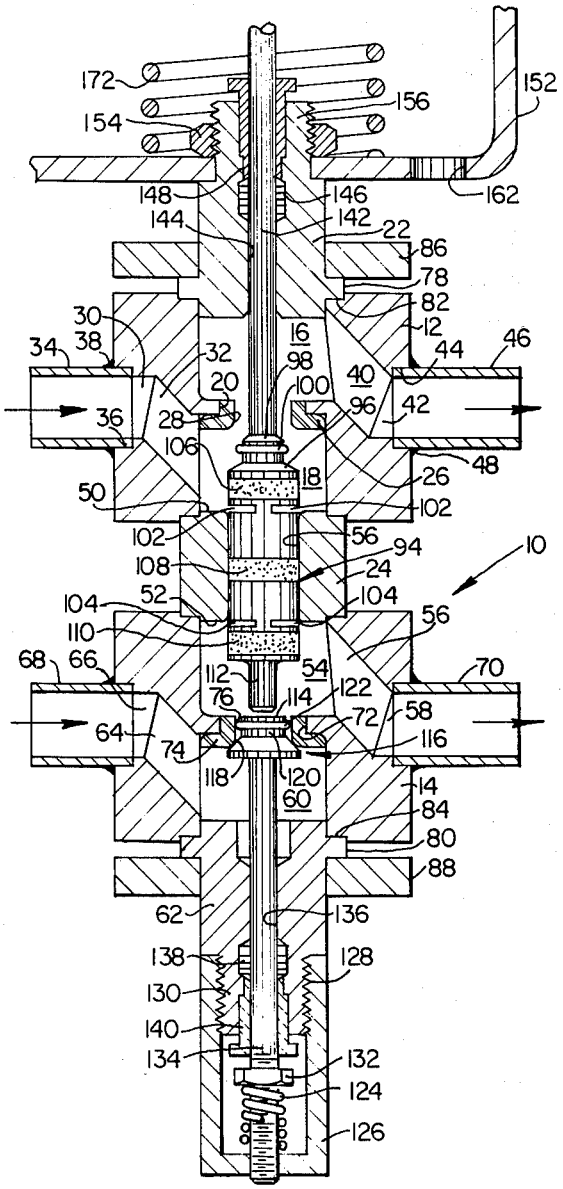
FIG. 3 is a vertical sectional view similar to FIG. 1 but showing the valve elements in a partially open or purge position.

As will be apparent, air under pressure may be supplied through the port 164 for actuation of the diaphram 166, the stem 142 and its valve and actuator member 94, the spring 172 supplying the necessary biasing or return force. Moreover, it will be apparent that appropriate control or regulation of air pressure will result in initial movement of the valve and actuator member to an intermediate or purge position as illustrated in FIG. 3. On an increase in regulated pressure supplied through the port 164, further downward movement of the valve and actuator member 94 will occur to the running position of FIG. 4. Subsequently, an appropriate reduction in supply pressure will allow the return spring 172 to urge the diaphram, stem and the valve and actuator member upwardly to the closed position. Alternatively and if desired, a step reduction in pressure can be employed to move the valve and actuator member sequentially from the running position to the purge position and then to the closed position.

Referring now to FIG. 3, it will be observed that the valve and actuator member 94 is illustrated in the purge position as indicated above. The frusto-conical seating surface 96 is displaced axially downwardly from the annular seat 26 whereby to open the steam inlet chamber 18 to the steam discharge chamber 16 through the opening in the valve seat. Thus, a first passageway is provided interconnecting the steam inlet and discharge ports. Said passageway comprises the steam inlet port, the inlet chamber 18, the seat opening 28, the steam discharge chamber 16, and the steam discharge port and flow will occur therethrough for the introduction of steam to a steam line which may be connected with the fitting 46. Purging of steam lines is not ordinarily required and accordingly, such flow may be regarded as merely incidental.

Steam flow through a second passageway is, however, significant and results in the necessary purging of the oil line or conduit. Said second passageway comprises the steam inlet port, the steam inlet chamber 18, the cylindrical opening 56, the oil discharge chamber 54, and the oil discharge port. More particularly, the intermediate portion of the passageway is formed by the radial openings 102 and 104 in the valve and actuator member 94 and the internal interconnecting valve passageway. As stated above, the axial spacing of the radial openings 102, 104 is judiciously selected in relation to the axial dimension of the opening 56 and, as will be observed in FIG. 3, the axial spacing of the openings is slightly greater than the axial dimension. Thus, free communication is established between the steam inlet and oil discharge chambers for the purge operation. The intermediate seal 108 prevents the reverse leakage of steam between and along the valve and actuator member and the wall of the cylindrical opening 56.

Reverting now to FIG. 1, it will be observed that the axial spacing of the radial openings 102, 104 is such that the lower opening 104 is closed by the wall of the opening 56 when the valve and actuator member is in its closed position. Thus, steam is not permitted to leak from the steam inlet chamber to the oil discharge chamber. Lower seal 110 serves to prevent steam leakage to the oil discharge chamber 54.

Figure 4:
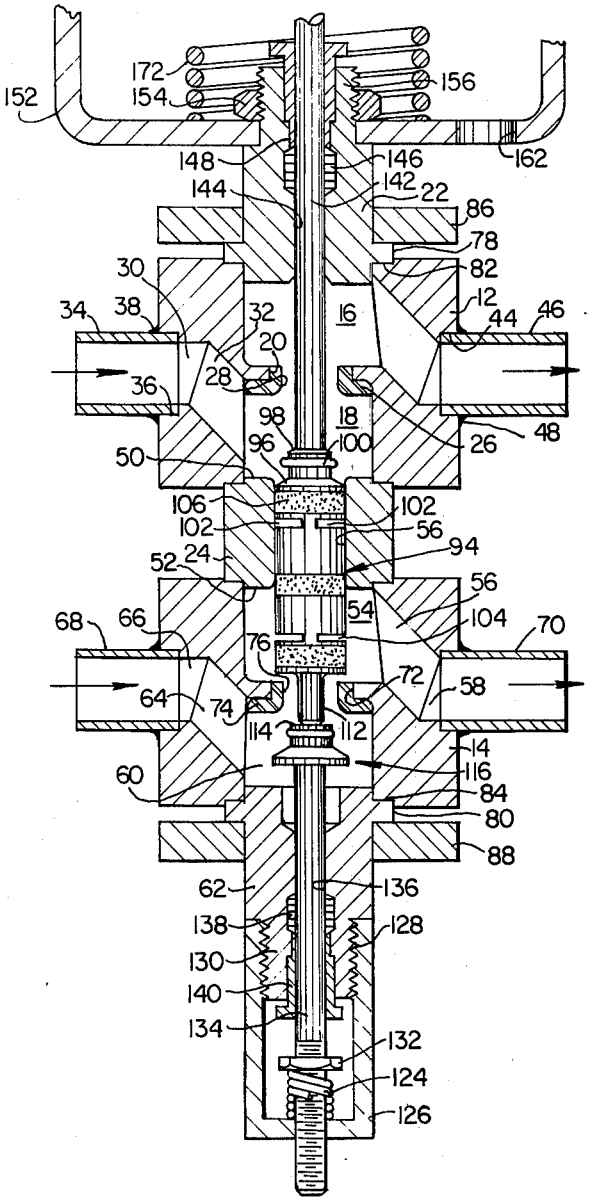
FIG. 4 is a vertical sectional view similar to FIGS. 1 and 3 but showing the valve elements in a fully open or running position.

In FIG. 4, the valve and actuator member 94 is shown in its third or running position. Steam is free to flow as above through the steam inlet port, the steam inlet chamber 18, the valve seat opening 28, the steam discharge chamber 16 and the steam discharge port. Further, the actuating pin 112 engages the surface 114 in this position and the oil valve member 116 is urged to its open position against the biasing force of the spring 124. Fuel oil flow thus occurs through a third passageway interconnecting the oil inlet and discharge ports, said passageway comprising the oil inlet port, the oil inlet chamber 60, the valve seat opening 76, the oil discharge chamber 54 and the oil discharge port. Simultaneous outflow of steam and oil thus results respectively through the steam and oil discharge ports.

The function of the uppermost or first seal 106 is also to be observed in FIG. 4. Oil which is permitted to enter the radial openings 104, 104 and pass upwardly through the internal valve passageway is blocked from flowing outwardly through the radial openings 102, 102 by the wall of the cylindrical opening 56. However, the seal 106 prevents such oil from passing upwardly between the valve and actuator member and the wall of the opening to the steam inlet chamber. Conversely, steam in the inlet chamber 18 is prevented from flowing downwardly along the wall of the opening 56 and adjacent the valve and actuator member so as to enter the radial openings 102, 102, exit from the radial openings 104, 104 and intermix with oil in the oil discharge chamber 54.

In a valve forming an alternative embodiment of the invention in FIGS. 5 through 8, valve operation is substantially identical with that described above but valve construction varies somewhat from that above. A valve 200 has a central or intermediate body part 202 which takes a cylindrical form and which has associated upper and lower closure members or plugs 204, 206. The plug 204 may be secured to the body 202 by means of appropriate screws or bolts 208, 208 and the plug 206 may be secured by appropriate screws or bolts 210, 210. The screws 210, 210 may also secure a housing 212 for a biasing means comprising a spring 214 associated with an oil valve member 216.

A steam inlet port is shown at 218 and a steam discharge port at 220. Oil inlet port 222 has a corresponding discharge port at 224. Steam inlet chamber 226 communicates with the inlet port 218 and a cylindrical opening 228 forms a steam discharge chamber in communication with steam discharge port 220. Oil inlet chamber 230 communicates with oil inlet port 222 and oil discharge chamber 232 communicates with oil discharge port 222.

A first passageway for the flow of steam from the steam inlet port 218 to the steam discharge port 220 thus comprises steam inlet chamber 226 and steam discharge chamber 228 and communication is established between said two chambers by an opening 234 in a first valve seat 236. A second valve seat 238 has an opening 240 which establishes communication between steam discharge chamber 228 and oil discharge chamber 232. A third opening 242 in a third valve seat 244 establishes communication between oil inlet chamber 230 and oil discharge chamber 232.

A steam valve and actuator member indicated generally at 246 has an upper or actuating stem 248 which may have an associated actuator, not shown, as in the valve embodiment illustrated and described above in FIGS. 1–4. Sealing means for the stem 248 are indicated generally at 250 and may have a biasing spring 252 associated therewith. A lower stem or actuating pin 254 of the steam valve and actuating member extends through the opening 240 in the second valve seat 238 and is of reduced diameter with respect to the opening to provide for the downward flow of steam thereabout from the steam discharge chamber 228 to the oil discharge chamber 232. The lower stem or actuating pin 254 cooperates with the oil valve member 216 in the manner described above for the valve of FIGS. 1 through 4.

At an intermediate portion thereof, the steam valve and actuator member 246 has a reduced diameter valve element 256 which is movable in one and an opposite direction in the cylindrical opening or chamber 228 and which cooperates with the first and second valve seats 236, 238. A first annular seating surface 258 at an upper portion of the valve element 256 cooperates with the valve seat 232 and a second annular seating surface 260 at a lower portion thereof cooperates with the valve seat 238. Preferably and as shown, the upper and lower portions of the valve element 256 and the annular seating surfaces 258, 260 are of a partispherical configuration.

The oil valve member 216 has a flange 262 providing a seating surface cooperating with the valve seat 244 and a soft seal may also be provided at 264 for preliminary closing. A stem 266 for the oil valve member 216 extends through sealing means 268 and 270 and downwardly into the housing 212 for connection with biasing spring 214. As described above for the valve of FIGS. 1–4, the biasing spring 214 normally maintains the oil valve member 216 in the closed position shown for the first and second positions of the steam valve and actuator member 246. In the third position of the steam valve and actuator member 246 the oil valve 216 is opened by the stem or pin 254 against the urging of the spring 214.

Figure 5:
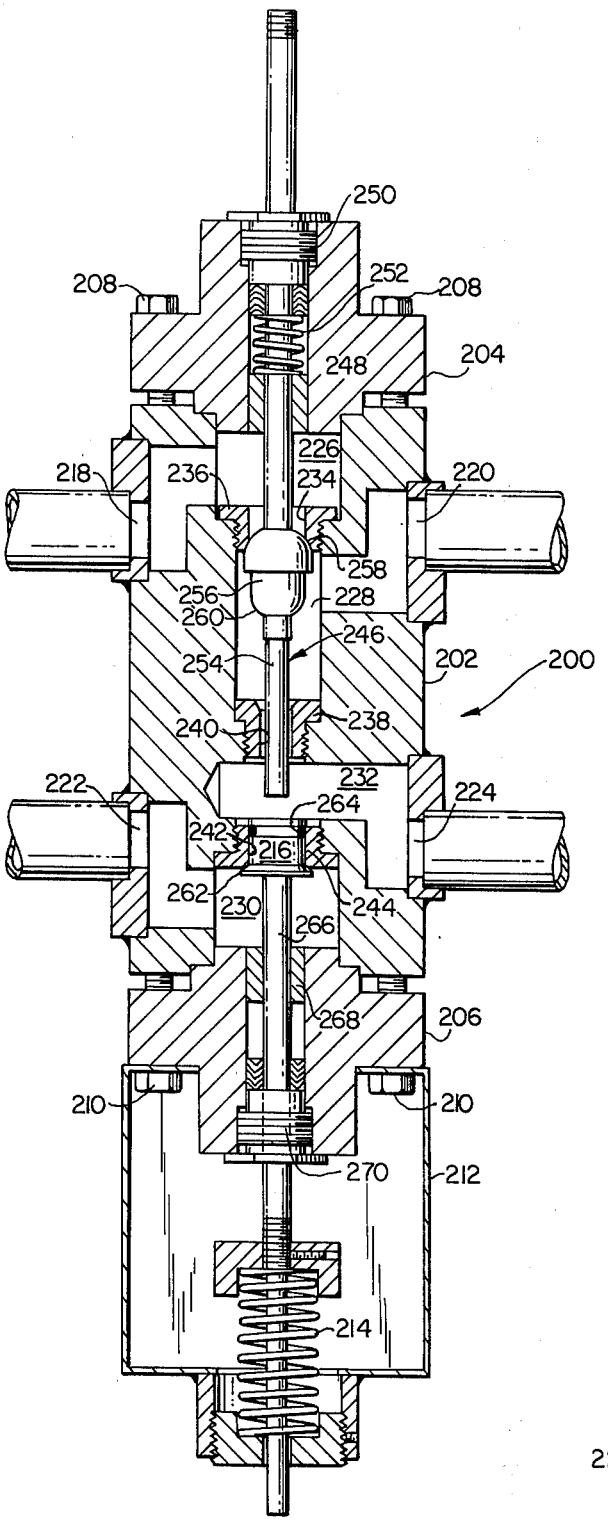
FIG. 5 is a vertical sectional view similar to FIG. 1 but showing a second form of the valve of the present invention.
Figure 6:
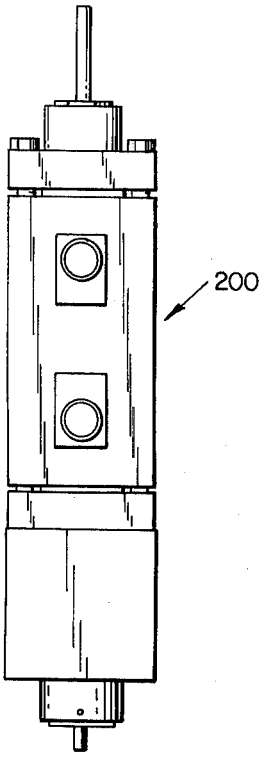
FIG. 6 is a front elevation of the valve of FIG. 5.

In operation, the valve of FIGS. 5–8 assumes a first position as illustrated in FIG. 5 under the command of its actuator which may be of an electrical or pneumatic type or of the exemplary type of FIGS. 1–4. In this position of the steam valve and actuator member 246, the first, second and third passageways are closed.

Figure 7:
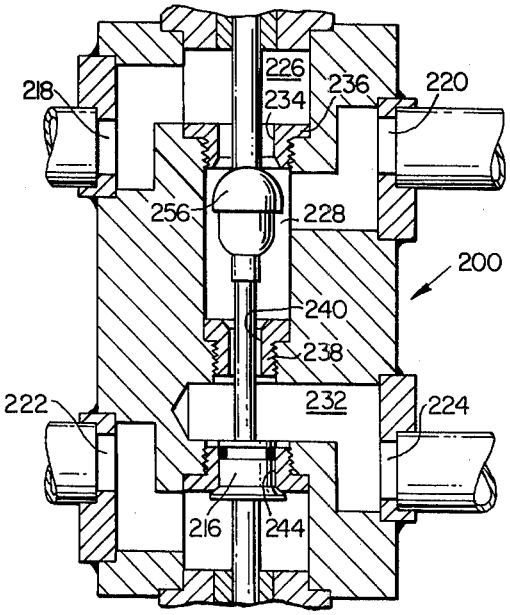
FIG. 7 is a fragmentary vertical section showing the FIG. 5 valve in a purge position.

In a second or purge position of the valve of FIGS. 5–8 the element 256 of the steam valve and actuator member 246 is moved downwardly to the position shown in FIG. 7. Steam flowing inwardly through the inlet port 218 passes through the steam inlet chamber 226 the opening 234 in the valve seat 236 and enters the steam discharge chamber 228. Steam in chamber 228 flows to the steam line through the steam discharge port 220 and also flows downwardly about the valve element 256 and the stem or pin 254 and through the opening 240 in the second valve seat 238 to the oil discharge chamber 232. From the oil discharge chamber 232 the steam flows through the oil discharge port 224 for the required purging of the fuel oil lines.

Figure 8:
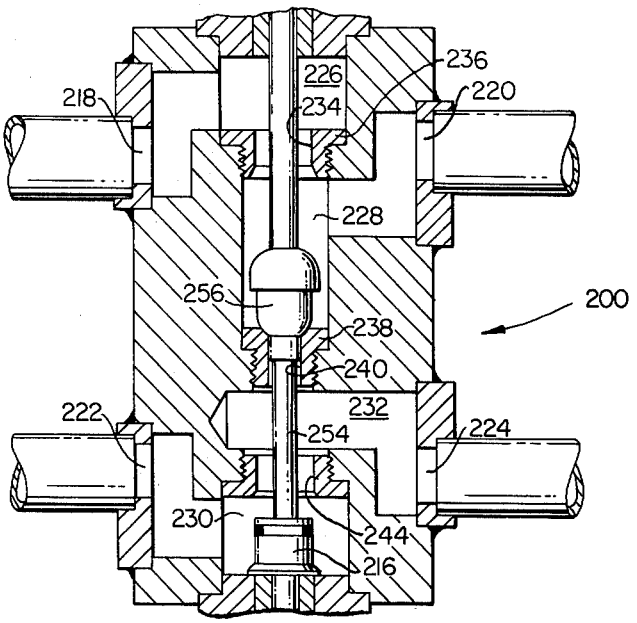
FIG. 8 is a fragmentary vertical section showing the FIG. 5 valve in a fully open or running position.

In FIG. 8 the valve is shown in its operating or running condition. In this position the valve element 256 seats at the second valve seat 238 whereby to close the opening 240 to the downward flow of steam to the oil discharge chamber to 232. Thus, steam flows through the first passageway comprising the inlet port 218, the chamber 226, the seat opening 234, the chamber 228, and the steam discharge port 220 and steam is supplied as required for combustion. The necessary supply of oil occurs through the third passageway comprising the oil inlet port 222, the oil inlet chamber 230, the seat opening 242, the oil discharge chamber 232 and the oil discharge port 224. Thus, both steam and oil are supplied as required for combustion and the second passageway of the valve is positively closed at the valve seat 238 to prevent steam leakage to the oil supply line.

Assembly and disassembly of the valve of FIGS. 5–8 for cleaning or other purposes is readily achieved on removal of the plugs 204 and 206. The valve seats 236, 238 and 244 are threaded into their assembled positions and can be readily removed. The various sealing means associated with the stems of the steam valve and actuator member 246 and the oil valve member 216 may be removed and the valve members themselves may be readily removed, cleaned replaced, etc.

From the foregoing, it will be apparent that a valve of a relatively simple construction has been provided. A desirably simple and straightforward three-position mode of operation is employed and yet the necessary selective switching of fluid flow is efficiently achieved. Positive sealing functions are achieved throughout and a high degree of each and convenience is provided for in disassembly and maintenance.

I claim:

1. A combination steam and fuel oil control and purge valve comprising a valve body defining steam and oil inlet ports, steam and oil discharge ports, a first passageway interconnecting said steam inlet and discharge ports, a second passageway interconnecting said steam inlet port and said oil discharge port, and a third passageway interconnecting said oil inlet and discharge ports, a steam valve and actuator member movable between first, second and third positions in said valve body and operable to open and close said first and second passageways, an oil valve member movable between first and second positions respectively to open and close said third passageway, biasing means urging said oil valve member toward its second position, said steam valve and actuator member in its first position closing said first and second passageways, said valve and actuator member in its second position opening said second passageway for a steam purge operation, and said valve and actuator member in its third position opening said first passageway, closing said second passageway and actuating said oil valve member whereby to urge said member in opposition to said biasing means and open said third passageway, steam and oil being thus passed respectively through said first and third passageways for simultaneous outflow through their respective discharge ports.

2. A combination steam and fuel oil control and purge valve as set forth in claim 1 wherein said steam valve and actuator member is of a generally cylindrical and axially slidable type with first and second axially spaced openings and an internal axially extending passageways interconnecting the same, and wherein an axially elongated cylindrical opening in said valve body defines an intermediate portion of said second passageway and slidably receives said valve and actuator member, the axial spacing of said valve member openings being greater than the axial dimension of said cylindrical body opening and so related thereto that said first and second openings respectively communicate with adjacent portions of said second passageway and thus with said steam inlet port and said oil discharge port whereby to open said second passageway when said valve member is in its second position, but said spacing and dimensional relationship being such that at least one of said valve member openings is closed by the wall of said cylindrical opening when said valve and actuator member is in each of its first and third positions to close said second passageway.

3. A combination steam and fuel oil control and purge valve as set forth in claim 2 wherein a seating surface is provided on said valve and actuator member in said first passageway, and wherein a first valve seat is provided in said first passageway so as to be engaged by said seating surface and to close said passageway when said valve and actuator member is in its first position, said seating surface being spaced from said seat to open said passageway when said valve and actuator member is in its third position.

4. A combination steam and fuel oil control and purge valve as set forth in claim 3 wherein said valve seat is of the annular type with a central through opening therein forming a part of said first passageway, and wherein said seating surface on said valve and actuator member is annular in form but centrally closed and spaced axially in one direction along said member from said first and second openings therein, said axial spacing being such that at least one of said openings in said member is closed by the wall of said cylindrical body opening when said seating surface engages said seat.

5. A combination steam and fuel oil control and purge valve as set forth in claim 3 wherein said spacing and dimensional relationship is such that said first opening in said valve and actuator member is open to said first passageway while said second opening therein is closed by said wall of said cylindrical body opening when said valve and actuator member is in said first position, and such that said first opening is closed by said wall and said second opening is open to said third passageway when said valve and actuator member is in said third position.

6. A combination steam and fuel oil control and purge valve as set forth in claim 5 wherein said steam valve and actuator member is provided with first, second and third annular sealing means engageable with the wall of said cylindrical valve body opening, said first and third sealing means being disposed axially outwardly respectively of said first and second valve and actuator member openings, and said second sealing means being disposed between said two openings, said second and third sealing means serving to prevent steam and oil leakage along and between said valve and actuator member and said wall of said cylindrical valve body opening when said member is in said first position, and said first and second sealing means serving to prevent steam and oil leakage along and between said valve and actuator member and said wall of said cylindrical valve body opening when said member is in its third position.

7. A combination steam and fuel oil control and purge valve as set forth in claim 4 wherein an annular centrally closed seating surface is provided on said oil valve member in said third passageway, and wherein a second valve seat is provided in an annular form with a central through opening which forms a part of said third passageway, said surface being maintained in engagement with said seat to close said third passageway by the action of said biasing means on said valve member, and said surface being displaced from said seat to open said third passageway by the action of said steam valve and actuator member on said oil valve.

8. A combination steam and fuel oil control and purge valve as set forth in claim 7 wherein said first and second seats, said cylindrical valve body opening, and said two valve members are arranged in axial alignment with said steam valve and actuator member and said cylindrical body opening in intermediate positions and said first and second seats facing in the same direction but respectively disposed adjacent opposite ends of said steam valve and actuator member, and with said oil valve member disposed on the side of said second seat opposite said steam valve and actuator member.

9. A combination steam and fuel oil control and purge valve as set forth in claim 8 wherein said steam valve and actuator member includes an axially projecting actuating pin at an end adjacent said oil valve member, said pin engaging said oil valve member with said steam valve and actuator member in its said third position and serving to maintain said oil valve member in its said first position against the urging of said biasing means whereby to disengage said seating surface from said second seat and to open said third passageway.

10. A combination steam and fuel oil control and purge valve as set forth in claim 9 wherein said first passageway comprises a cylindrical steam inlet chamber defined in said valve body about said steam valve and actuator member and communicating with said steam inlet port, said through opening in said first valve seat communicating with said chamber, and a cylindrical steam discharge chamber communicating with said through opening and said steam discharge port, wherein said second passageway comprises said steam inlet chamber, said cylindrical opening in said valve body, said valve member openings and passageway, and a cylindrical oil discharge chamber communicating with said cylindrical valve body opening and said oil discharge port, and wherein said third passageway comprises a cylindrical oil inlet chamber communicating with said oil inlet port, said through opening in said second valve seat and said oil discharge chamber, said second valve seat being disposed between said oil inlet and discharge chambers for communication therebetween.

11. A combination steam and fuel oil control and purge valve as set forth in claim 10 wherein said steam valve and actuator member has an axially elongated actuating stem projecting from an end opposite said actuating pin, and wherein said oil valve member is provided with an axially elongated stem projecting therefrom in a direction opposite said second valve seat, said oil valve stem being operatively associated with said biasing means.

12. A combination steam and fuel oil control and purge valve as set forth in claim 11 wherein said biasing means comprises a spring urging said oil valve stem in a direction to engage said seating surface on said oil valve member with said second valve seat.

13. A combination steam and fuel oil control and purge valve as set forth in claim 11 and including an actuator operatively associated with said stem on said steam valve and actuator member.

14. A combination steam and fuel oil control and purge valve as set forth in claim 1 wherein said steam valve and actuator member is of the axially slidable type, and wherein an axially elongated cylindrical opening in said valve body defines an intermediate portion of said second passageway and slidably receives at least a portion of said valve and actuator member, said valve and actuator member serving to close said cylindrical opening and thus close said second passageway in its said first and third positions and to open said passageway in its said second position.

15. A combination steam and fuel oil control and purge valve as set forth in claim 14 wherein a seating surface is provided on said valve and actuator member in said first passageway, and wherein a first valve seat is provided in said first passageway so as to be engaged by said seating surface and to close said passageway when said valve and actuator member is in its first position, said seating surface being spaced from said seat to open said passageway when said valve and actuator member is in its third position.

16. A combination steam and fuel oil control and purge valve as set forth in claim 15 wherein a second setting surface is provided on said valve member and actuator in said second passageway, and wherein a second valve seat is provided in said second passageway so as to be engaged by said second seating surface and close said second passageway when said valve member and actuator is in its third position.

17. A combination steam and fuel oil control and purge valve as set forth in claim 16 wherein said first and second valve seats are annular and spaced axially in said elongated cylindrical opening in said valve body, said opening forming part of both said first and second passageways, and wherein said valve member and actuator has an intermediate element radially smaller than said opening forming said first and second seating surfaces on opposite ends thereof, the axial spacing between the seats being greater than that between the seating surfaces so that the element closes the first seat and opens the second in said first position, opens both seats in said second position, and closes the second seat in said third position.

18. A combination steam and fuel oil control and purge valve as set forth in claim 17 wherein said intermediate valve element has parti-spherical seating surfaces.

19. A combination steam and fuel oil control and purge valve as set forth in claim 17 wherein an annular centrally closed seating surface is provided on said oil valve member in said third passageway, and wherein a third valve seat is provided in an annular form with a central through opening which forms a part of said third passageway, said seating surface being maintained in engagement with said seat to close said third passageway by the action of said biasing means on said valve member, and said surface being displaced from said seat to open said third passageway by the action of said steam valve and actuator member on said oil valve.

20. A combination steam and fuel oil control and purge valve as set forth in claim 19 wherein said steam valve and actuator member includes an axially projecting actuating pin at an end adjacent said oil valve member, said pin engaging said oil valve member with said steam valve and actuator member in its said third position and serving to maintain said oil valve member in its said first position against the urging of said biasing means whereby to disengage said seating surface from said third seat and to open said third passageway.

21. A combination steam and fuel oil control and purge valve as set forth in claim 20 wherein said first, second and third seats, said cylindrical valve body opening, and said two valve members are arranged in axial alignment with said steam valve and actuator member and said cylindrical body opening in intermediate positions and said first and second seats facing in opposite directions and respectively disposed adjacent opposite ends of said intermediate element on said steam valve and actuator member, and with said third valve seat and oil valve member disposed on the side of said second seat opposite said steam valve and actuator member.

22. A combination steam anf fuel oil control and purge valve as set forth in claim 21 wherein said first passageway comprises a cylindrical steam inlet chamber defined in said valve body about said steam valve and actuator member and communicating with said steam inlet port, said through opening in said first valve seat communicating with said chamber, and said cylindrical opening in said valve body communicating with said through opening and said steam discharge port, wherein said second passageway comprises said steam inlet chamber, said cylindrical opening in said valve body, and a cylindrical oil discharge chamber communicating with said cylinrical valve body opening and said oil discharge port, and wherein said third passageway comprises a cylindrical oil inlet chamber communicating with said oil inlet port, said third valve seat and said oil discharge chamber, said third valve seat being disposed between said oil inlet and discharge chambers for communication therebetween.

23. A combination steam and fuel oil control and purge valve as set forth in claim 22 wherein said steam valve and actuator member has an axially elongated actuating stem projecting from an end opposite said actuating pin, and wherein said oil valve member is provided with an axially elongated stem projecting therefrom in a direction opposite said third valve seat, said oil valve stem being operatively associated with said biasing means.

24. A combination steam and fuel oil control and purge valve as set forth in claim 23 wherein said biasing means comprises a spring urging said oil valve stem in a direction to engage said seating surface on said oil valve member with said third valve seat.

* * * * *